United States Patent [19]

Aschberger et al.

[11] Patent Number: 4,646,797

[45] Date of Patent: Mar. 3, 1987

[54] SYSTEM FOR THE PLUGGABLE FLANGING OF A PRESSURE VESSEL ONTO A GAS-WITHDRAWAL UNIT

[75] Inventors: Matthias Aschberger; Karlheinz Färber, both of Giengen; Anton Deininger, Bachhagel, all of Fed. Rep. of Germany

[73] Assignees: The Coca-Cola Company, Atlanta, Ga.; Bosch-Siemens Hausgeräte GmbH, Munich, Fed. Rep. of Germany

[21] Appl. No.: 768,363

[22] Filed: Aug. 22, 1985

[30] Foreign Application Priority Data

Aug. 22, 1984 [DE] Fed. Rep. of Germany ..... 3430900
Aug. 22, 1984 [DE] Fed. Rep. of Germany ..... 3430926
Aug. 22, 1984 [DE] Fed. Rep. of Germany ..... 3430928

[51] Int. Cl.[4] ..... B65B 3/04
[52] U.S. Cl. ..... 141/375; 141/392
[58] Field of Search ..... 141/369–381, 141/392

[56] References Cited

U.S. PATENT DOCUMENTS 2,453,080 11/1948 Shimp ..... 141/375

*Primary Examiner*—Houston S. Bell, Jr.
*Attorney, Agent, or Firm*—Birch, Stewart, Kolasch & Birch

[57] ABSTRACT

An easy to use system for connecting a bottle-type, gas containing pressurized vessel to a gas-withdrawal unit includes a valve assembly mounted on the pressurized vessel. A longitudinal axis of this valve assembly is substantially perpendicular to a longitudinal axis of the pressurized vessel resulting in an offset outlet design. The system also includes a housing with slotted links for guiding and holding the pressurized vessel as well as a centering device located in front of the gas-withdrawal unit for aiding alignment of an outlet of the valve assembly with an inlet port of the gas-withdrawal unit. A pivot lever is also provided to press and hold the outlet of the valve assembly gastight against the inlet port of the control unit.

14 Claims, 3 Drawing Figures

SYSTEM FOR THE PLUGGABLE FLANGING OF A PRESSURE VESSEL ONTO A GAS-WITHDRAWAL UNIT

DESCRIPTION

The invention relates to a system for the connecting of a bottle-type pressure vessel containing gas under pressure and having a controllable valve assembly to a gas-withdrawal unit. This gas withdrawal unit has a control unit for regulating the pressure of the drawn-off gas and for coacting with the valve assembly of the pressure vessel.

As an example, these systems can be employed in beverage dispensers which mix beverage concentrates with soda water to make a soft drink. In these devices, the soda water is obtained by enriching fresh water with $CO_2$ gas in a preferably refrigerated storage vessel. For the individual use of such devices, it is expedient and desirable to make the replacement of the $CO_2$ as simple as possible so that anybody can do it. Normally, the $CO_2$ storage vessels are screwed into the gas-withdrawal unit. However, it is also common practice to use a connector to couple the $CO_2$ pressure vessel with the gas-withdrawal unit and to maintain this coupling by applying an appropriate coupling pressure to the vessel.

Two main problems are encountered in conventional systems. One is that great care must be exercised when fitting together the flanges of the storage vessel and those of the gas-withdrawal unit without such care, damage can easily occur which usually lead to gas leaks. The second problem with prior art systems is that the coupling pressure is applied over the entire gas cylinder. This design requires a suitably stable housing capable of absorbing these forces as well as a high degree of manufacturing accuracy. By using elastic pressure means, e.g., spring pressure, this problem can only be partially solved as great care is still needed in connecting the pressurized vessel and gas-withdrawal unit.

SUMMARY OF THE INVENTION

Therefore, one object of the invention is to provide a system for connecting of a bottle-type pressure vessel onto a gas-withdrawal unit, which, despite its simple construction, ensures ease of operation and a reliable coupling.

According to the invention, a system that meets the above requirements is characterized by a gas-withdrawal unit (2) having a manually operated pivoting lever mounted thereon. This pivoting lever permits the value assembly of the pressure vessel to be gripped on its actuating flanges and to be pressed against the inlet port opening of the gas-withdrawal unit.

A system designed in accordance with these novel features satisfies the above prerequisites in that a manually operated pivoting lever is hinged on the gas-withdrawal. This lever can then be operated to grip operating flanges on the sides of a valve assembly mounted upon gripping of the flanges by the pivoting lever, the outlet of the value assembly can be and pressed against the inlet port opening of the gas-withdrawal unit. In this way, the force required for holding the valve outlet against the port inlet is applied only in the immediate vicinity of the flanges to be joined. Damage to the flanges can thus largely be avoided. Due to the relatively short distances to be spanned, one can dispense conventional with elastic pressing mechanisms. Accordingly any damage in the flanged area will usually become evident when operation of the system is difficult or impossible. Thus, an operator will be alerted to the presence of faulty conditions in the flanged areas. This system also avoids the problems of contamination of the handled material.

For force requirement reasons, it is advantageous for the flanged area between the gas-withdrawal unit and the valve assembly to be positioned between the bearing point of the pivoting lever on the withdrawal unit and the operating faces of the valve assembly for the pivoting lever.

According to a preferred embodiment, the system embodying the invention is characterized by the fact that operating lugs for the pivoting lever of the gas-withdrawal unit are provided on opposite sides the valve assembly. This results in the simple creation of points for the application of force by the pressing mechanism during manual operation of the pivoting lever. A further improvement of the novel system is the use of two areas of force application between the valve assembly and the pivoting lever. The first area of force application involves the pivoting lever and the operating lugs of the valve assembly. This force moves the valve seats toward each other to the operating position in a first swiveling phase of the pivoting lever. The second area of force application involves a resilient intermediate member which presses bolt 18 against the valve assembly. This force applies a short lift to the valve assembly and the pressurized vessel to assure contact pressure. This resilient intermediate member is preferably integrated into the pivoting lever.

In the vicinity of the port opening of the gas-withdrawal unit of a system there is mounted a centering device for the valve assembly of the pressure vessel. This centering device is opened on the end surface perpendicularly to the receiving direction and by means of a pressing mechanism, the valve assembly can be pressed against the port opening of the gas-withdrawal unit, thus being moved perpendicularly to the centering device.

A system having the features taught by the invention particularly meets the demands made upon it in that the centering device for the valve assembly, which is opened on one end surface, brings about a convenient and easy-to-execute preliminary centering of the two flanges relatively to each other. In this position, the valve assembly can be moved by the pressing mechanism to abut gastight against the port opening of the gas-withdrawal unit and can be pressed thereagainst. Thus, the flanges are protected from being damaged.

In another preferred embodiment of the novel system, ease of the operation is improved by providing stationary slotted links for the gas pressure vessel in the housing device. These links can guide the valve assembly toward the centering device during the fitting of the gas pressure vessel. These steps practically result in a centering funnel.

Another feature is the offset design of the valve assembly. The port opening of the valve assembly is aligned such as to be bent aside in relation to the axis of the pressure vessel. Preferably, the valve assembly is offset substantially perpendicularly to the longitudinal axis of the pressure vessel.

The offset positioning of the valve assembly in relation to the axis of the pressure vessel offers very favorable preconditions for the handling of the pressure vessel. The coupling of the flanges of the valve assembly with the gas-withdrawal unit can occur perpendicularly to the axis of the pressure vessel. This design allows the coupling to occur remotely from the center of gravity of the pressurized vessel. Thus, the mass of the pressurized vessel has only a slight effect on the coupling operation.

Preferably, the offset design of the valve assembly can also be exploited such that operating lugs on the valve assembly form areas for receiving the force applied by the pivoting lever mounted on the gas-withdrawal unit.

All things considered, a system incorporating the invention satisfies the demands made up it. The system may be arranged with the pressure vessel being mounted in the housing device with the outlet of the valve assembly being substantially perpendicular to the longitudinal axis of the pressure vessel and having a laterally aligned flanged opening. Additionally, in the vicinity of the inlet port opening of the gas-withdrawal unit there is an (upward opened) precentering device for the valve flange. Also a locking mechanism comprising a pivoting lever which is swivel-mounted on the gas-withdrawal unit is provided the valve assembly gastight to the port opening of the gas-withdrawal unit, with the valve assembly overlapping the port opening.

A system designed in accordance with the novel features satisfies the demands made upon it in many respects. To install the pressure vessel in the housing apparatus, all that is required is a first step is to grip the pressure vessel in the area of the offset valve assembly and to bring it, with the bottom out in front, into a recipient chamber of the housing apparatus. Because of the appropriately mounted slotted links, the gas-pressure vessel is guided into the area of its final work position and is gripped in the area of the offset valve assembly by the precentering device mounted in front of the gas-withdrawal unit. All that is now needed is to bring the valve assembly as closely as possible to the gas-withdrawal unit by pivoting the lever of the locking mechanism join the two functional parts gastight together. The resulting force is only between the gas-withdrawal unit and the valve assembly via the manually operated pivoting lever. As a result of the relatively short distances to be spanned, elastic pressing mechanisms for tolerance compensation can be omitted. Accordingly any damage in the flanged area will very likely become evident when operating conditions are difficult or impossible to meet, thus indicating to the operator the presence of faulty conditions in the flanged areas. Another problem avoided is the possibility of contaminations. In order to aid the coupling force provided by the pivoting lever, a short-lift spring element.

If provision is made according to the invention to mount the gas-pressure vessel in the housing apparatus in a substantially vertical position, then the gas-withdrawal unit shall be designed such that the center of gravity of the pressure vessel lies below the centering device for the offset part of the valve assembly. In this way, the center of gravity of the gas-pressure vessel will not have a tilting effect on the coupling connection.

As an additional measure for the protection of the flanges, the novel system is preferably characterized by the fact that, within an external branch in the area of the port opening of the valve assembly, a second centering branch of the valve assembly is provided for the coupling to the gas-withdrawal unit.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described with reference to a specific embodiment in conjunction with the accompanying drawing which are given by way of illustration only, and thus are not limitative of the present invention and, in which.

DESCRIPTION OF THE PREFERRED EMBODIMENT

Figure 1:
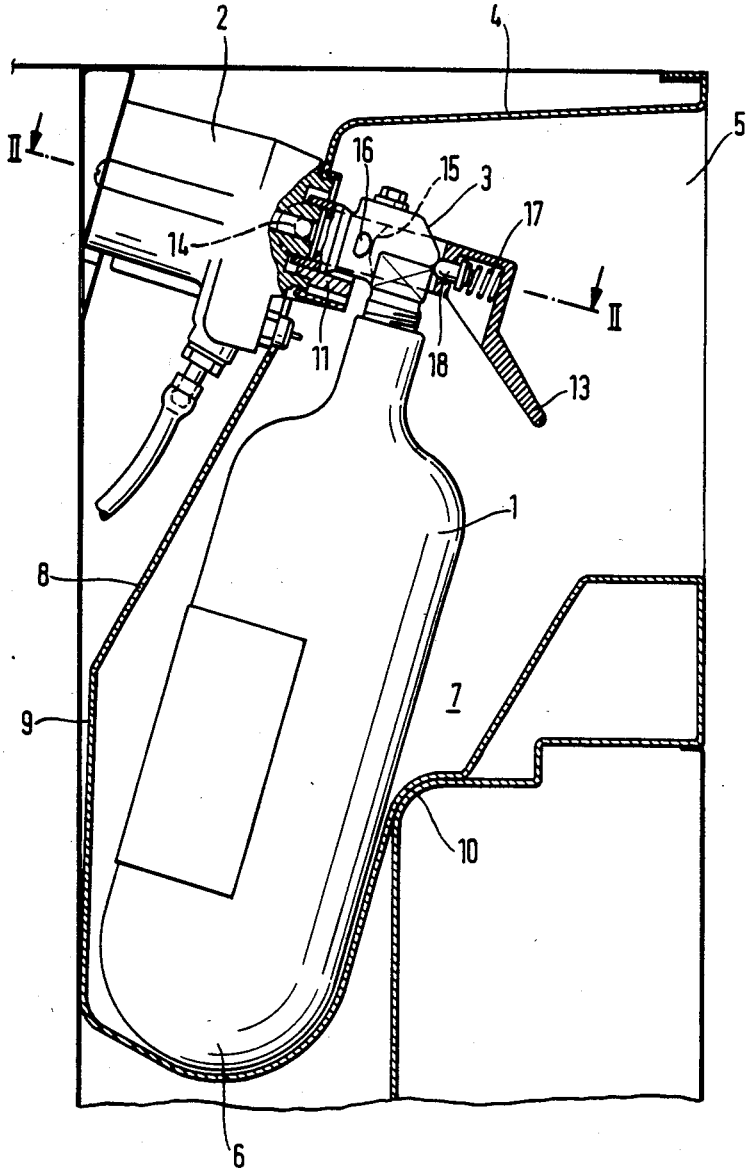
FIG. 1 is a side view, partially in section, a gas-withdrawal unit coupled to a gas containing pressurized vessel in a housing device.

The system depicted in the drawings serves for the withdrawal of $CO_2$ gas from a pressure vessel 1 by means of a gas-withdrawal unit 2 for a carbonizing tank of a beverage dispenser. In this carbonizing tank, fresh water is enriched with $CO_2$.

The gas-withdrawal unit 2 contains regulating elements that, in conjunction with a valve tappet of a valve assembly 3 mounted on the gas-pressure vessel 1, carry out a controlled reduction of the gas pressure prevailing in the gas-containing pressurized vessel 1 down to the operating pressure required in the carbonizing tank. The gas-withdrawal unit 2 is secured in the device housing 4 and thus forms part of the apparatus. The gas containing pressurized vessel 1 and the valve assembly 3 forms a functional unit, which supply the carbonizing tank with $CO_2$ gas and which are coupled to the gas-withdrawal unit 2.

For this purpose, and to facilitate and simplify the operation, the valve assembly 3 is given an offset design, i.e., a longitudinal axis through the outlet of the valve assembly is perpendicular to the longitudinal axis of the gas-pressure vessel. This design results in a succession of connecting movements for the coupling of the valve assembly 3 to the gas-withdrawal unit 2. The pressurized vessel 1 is inserted into the housing apparatus through the housing aperture 5, with its lower end 6 out in front. The pressurized vessel 1 is inserted into the receiving chamber 7 substantially along longitudinal axis of the pressurized vessel 1. Guided through the wall sections 8, 9, the pressurized vessel 1 is swung by mechanical means around the round edge 10 in the device housing 4 to reach a position where the valve assembly 3 finds its way to the area of the gas-withdrawal unit 2.

Figure 3:
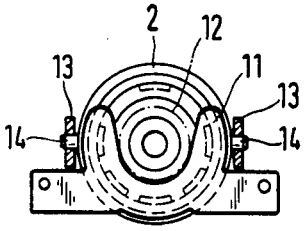
FIG. 3 is a view in the direction of the locating flange of the gas-withdrawal unit taken along line III—III of FIG. 2.
Figure 2:
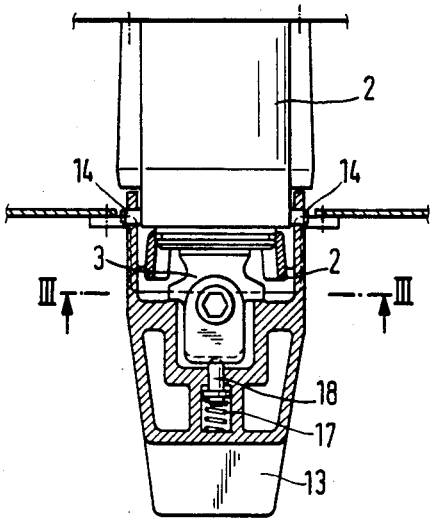
FIG. 2 is a top plan view of this system, partially in section taken along line II—II of FIG. 1.

A centering device 11 is mounted in front of the gas-withdrawal unit 2, via which the offset portion of the valve assembly is gripped, so that the mounting flange of the valve assembly 3 is centered with the couplementary mounting flange of the gas-withdrawal unit 2. To this end, the centering device 11 mounted in front of the gas-withdrawal unit 2—as shown in FIG. 3—is U-shaped with both arms pointing upwards. Accordingly during the insertion of the gas-pressure vessel 1, the centering device 11 grips the offset wedge 12 of the valve assembly denoted by the dot-dash line in FIG. 3 until the wedge 12 of the valve assembly bears against the floor of this centering device 11. The fitting position of the gas-pressure vessel 1 is selected such that its center of gravity lies essentially below this bearing point between the centering device 11 and the offset part 12 of the valve assembly. Thus, this precentered work position is essentially stable.

The gas-tight joint between the flanges of the valve assembly 3 and the gas-withdrawal unit 2 has to be brought out of this work position. To do this, a manually operated pivoting lever 13 is provided which is swivel-mounted on axial lugs 14 of the gas-withdrawal unit 2. FIGS. 1 and 3 depict the work position of the pivoting lever 13. This lever 13 acts via bevelled operating faces 15 on operating lugs 16 of the valve assembly 3. As a result of the downward pivoting movement of the manually operated pivoting lever 13 the corresponding flanges of the valve assembly 3 and of the gas-withdrawal unit 2 are fitted together axially. The final bearing pressure for these functional parts is applied by a spring element 17 mounted in the pivoting lever 13. This spring element 17 acts via a pressure bolt 18 on the valve portion of the valve assembly 3 opposite the mounting flange of the valve assembly 3. In this position, by means of this bolt 18, the pivoting lever 13 is also locked by mechanical force behind an elevation of the valve assembly 3.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A system for connecting a pressurized vessel having a longitudinal axis and containing gas under pressure to a gas-withdrawal unit comprising:

a controllable valve assembly having an outlet and having an axis coextensive with the valve assembly, said axis of said valve assembly extending through said outlet, said controllable valve being mounted on the pressurized vessel so that the axis of the pressurized vessel is substantially perpendicular to the axis of the valve assembly;

a control unit for the gas-withdrawal unit, said control unit regulating the pressure of gas withdrawn from the pressurized vessel and having an inlet port therein for coacting with the outlet of the valve assembly;

clamp means for pressing the outlet of the valve assembly against the port opening and for locking the outlet gastight to the inlet port; and centering means mounted on the gas-withdrawal unit for aligning the outlet of the valve assembly with the inlet port of the control unit in response to a clamping force generated by said clamp means.

2. A system according to claim 1 wherein the pressurized vessel has a center of gravity which lies below the centering means.

3. A system according to claim 1 wherein the clamp means is a pivot lever mounted on the gas-withdrawal unit.

4. A system for connecting a pressurized vessel containing gas under pressure to a gas-withdrawal unit comprising:

a controllable valve assembly having an outlet, said valve assembly being mounted on said pressurized vessel;

a control unit for the gas-withdrawal unit, said control unit regulating the pressure of gas withdrawn from the pressurized vessel and having an inlet port therein for coacting with the outlet of the valve assembly; and clamp means for gripping the valve assembly and pressing the outlet of the valve assembly gastight against the inlet port of the gas-withdrawal unit.

5. A system according to claim 4 wherein the clamp means is a pivot lever mounted on the gas-withdrawal unit by bearing means.

6. A system according to claim 5 comprising:

operating lugs mounted on said valve assembly, said lugs cooperating with the pivoting lever, and a flanged area between said valve assembly and said gas-withdrawal unit, said flanged area being located between said operating lugs and said bearing means when said outlet of the valve assembly is pressed gastight against the inlet port of the gas-withdrawal unit.

7. A system according to claim 6 wherein the operating lugs are mounted on opposite sides of the valve assembly.

8. A system according to claim 5 comprising two areas for the application of force, said two areas being are located between the valve assembly and the pivot lever.

9. A system according to claim 8 wherein a first area of said two areas for the application of force has a first force applied thereto by a resilient intermediate member, said resilient intermediate member being mounted to the pivot lever and contacting said valve assembly when said lever presses the outlet of the valve assembly against the inlet portion of the gas-withdrawal unit.

10. A system according to claim 9 wherein a second area of said two areas for the application of force has a second force applied thereto by the pivot lever when said pivot lever is actuated, said second force being applied by the pivot lever to operating lugs attached to opposite sides of the valve assembly.

11. A system for connecting a pressurized vessel containing gas under pressure to a gas-withdrawal unit comprising;

a controllable valve assembly mounted on the pressurized vessel;

a control unit for the gas-withdrawal unit, said control unit having an inlet port;

clamp means for moving the valve assembly toward the gas-withdrawal unit for permitting said control unit to coact with the valve assembly of said pressurized vessel; and centering means mounted on th gas-withdrawal unit for aligning the valve assembly with the inlet port in response to operation of the clamp means.

12. A system for connecting a bottle-type pressurized gas containing vessel having a longitudinal, coextensive axis to a gas-withdrawal unit having a control unit for regulating the pressure of gas withdrawn from the pressurized vessel comprising:

a valve assembly which coacts with the gas-withdrawal unit, said valve assembly having an outlet and having an axis coextensive with the valve assembly, said axis of said valve assembly extending through said outlet, and said valve assembly being fixedly mounted on the pressurized vessel so that the axis of the valve assembly is non-parallel to the axis of the pressurized vessel.

13. A system according to claim 12 wherein the axis of the valve assembly is substantially perpendicular to the longitudinal axis of the pressurized vessel.

14. A system for connecting a pressurized vessel containing gas under pressure to a gas-withdrawal unit comprising:

a controllable valve assembly mounted on the pressurized vessel;

said gas-withdrawal unit having a control unit for regulating the pressure of the gas withdrawn from the pressurized vessel and for connecting with the valve assembly of the pressurized vessel; and a housing having slotted links for guiding said pressurized vessel during loading of the pressurized vessel into the system and for supporting the pressurized vessel during operation.

* * * * *